US005613602A

United States Patent [19]

Lage et al.

[11] Patent Number: 5,613,602

[45] Date of Patent: Mar. 25, 1997

[54] CLIP-TYPE HOLDER FOR DISPLAYING A BUSINESS CARD

[75] Inventors: David P. Lage; Albert P. Carney, both of St. Louis County, Mo.

[73] Assignee: Quick Point, Inc., Fenton, Mo.

[21] Appl. No.: 343,340

[22] Filed: Nov. 22, 1994

[51] Int. Cl.[6] ..... G09F 3/18

[52] U.S. Cl. ..... 206/232; 206/449; 206/775; 40/666

[58] Field of Search ..... 206/44 R, 45.14, 206/45.31, 45.15, 232, 576, 449, 818, 775, 776, 778, 783; 24/303, 3.7, 3.11; 40/666, 1.6, 600

[56] References Cited

U.S. PATENT DOCUMENTS 3,335,467 8/1967 Freed ..... 40/666 X
4,209,925 7/1980 Brugmann ..... 40/666 X
4,292,749 10/1981 Thomas ..... 40/666 X
4,450,955 5/1984 Featherston .
5,267,374 12/1993 Drake ..... 24/303 X
5,285,577 2/1994 Carney et al. .

*Primary Examiner*—Jacob K. Ackun
*Attorney, Agent, or Firm*—Polster, Lieder, Woodruff & Lucchesi, L.C.

[57] ABSTRACT

A holder for supporting light objects, such as papers, on a ferrous metal surface and for further displaying a business card prominently in front of the surface, includes a clip having spring loaded legs which open to receive the object and close upon the object to retain it. One of the legs contains a magnet which holds the clip against the metal surface. The other leg has a carrier attached to it. The carrier includes a backing panel having a pocket which opens away from the clip and is configured to receive a business card. It also includes a transparent cover panel which overlies the pocket and protects the business card.

14 Claims, 2 Drawing Sheets

CLIP-TYPE HOLDER FOR DISPLAYING A BUSINESS CARD

BACKGROUND OF THE INVENTION

This invention relates in general to a holder for supporting paper and other light objects and more particularly a holder of that type which accepts and displays promotional material in card form, such as a business card.

Unobstructed metal surfaces exist in offices and homes, and individuals frequently use these surfaces to display messages or graphic material of one form or another. Typically the doors of home and office refrigerators are studded with small removable magnets. Simply, by inserting the paper carrying the message or graphic presentation between the magnet and the door, the paper remains on the door, it being held by the magnet. Metal file cabinets also provide excellent surfaces for displaying papers held in place with magnets.

The magnets may carry graphic presentations—such as advertising—but usually the magnets are so small, that little space exists for effective advertising. Indeed, the diminutive size often leaves them unnoticed among the larger papers that they hold. Apart from that, the simple magnet does not have the capacity to hold items of even modest bulk, such as towels and aprons.

The present invention resides in a holder for supporting light items on a ferrous metal surface. The holder includes a retainer which engages the item to be supported and a magnet to hold the device against the metal surface. In addition, it includes a carrier which receives and prominently displays a card, such as a business card.

The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
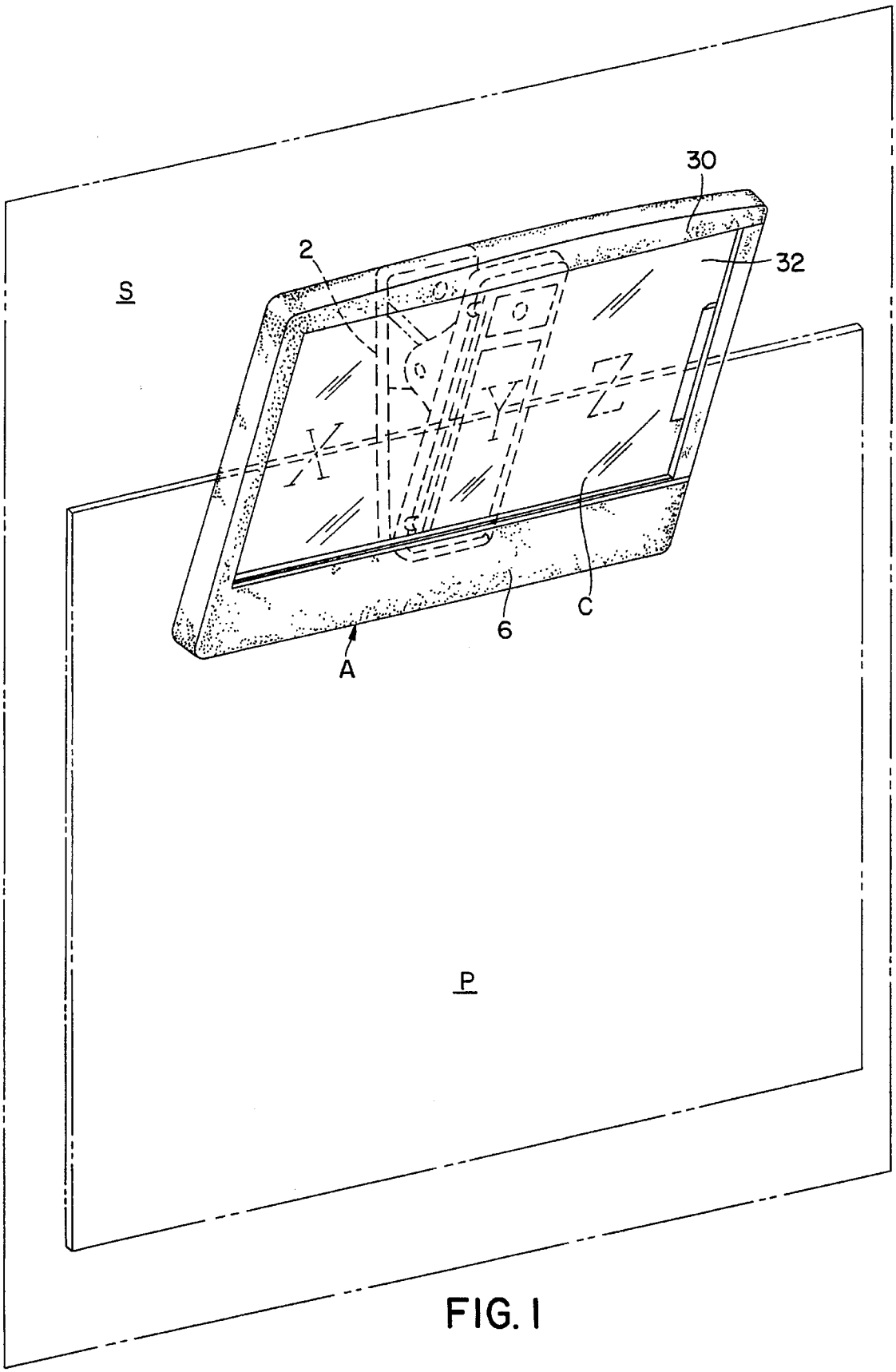
FIG. 1 is a perspective view of the holder of the present invention held against a metal surface and supporting a sheet of paper while further prominently displaying a business card.

Referring now to the drawings (FIG. 1), a holder A attaches easily to a flat vertical surface S on ferrous metal where it serves to support paper P or some other light object that is not very thick in front of the surface S. It further serves to display a business card C and perhaps some other message as well. The holder A basically includes a retainer in the form of a clip 2, a magnet 4 on the clip 2 for affixing it to the surface S, and a carrier 6 which is attached to the clip 2 and retains the card C, displaying it prominently in front of the surface S and in front of the paper P as well.

Figure 2:
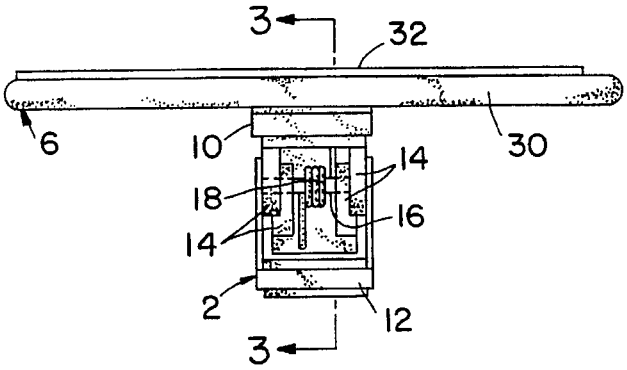
FIG. 2 is a top plan view of the holder.

Considering the clip 2, it includes (FIGS. 2 and 3) front and back legs 10 and 12, each provided with a pair of lugs or ears 14 near its side and intermediate its ends. The ears 14 of the back leg 12 lie inside the ears 14 for the front leg 10, and in the region of overlap the two legs 10 and 12 are connected by a pivot pin 16 which passes the ears 14. The pivot pin 16 in turn retains a spiral spring 18 which wraps around it and ends with extensions which bear against the opposing or inside faces of the legs 10 and 12. Indeed, during the assembly of the clip 2, the spring 18 is loaded, that is to say placed under stress, so that its extensions bear with moderate force against the inside faces of the legs 10 and 12 to urge the legs 10 and 12 together at their ends most remote from the pin 16. In this regard the ears 14 and pin 16 are offset somewhat from the midportions of the two legs 10 and 12, and divide each leg 10 and 12 into a clamping portion 20 and an actuating portion 22, the former being longer than the latter. The clamping portion 20 of the front leg 10 on its inside face has short teeth 24 to enhance the gripping capacity of the clip 2 on an object clamped between the clamping portions 20 of the two legs 10 and 12.

Figure 3:
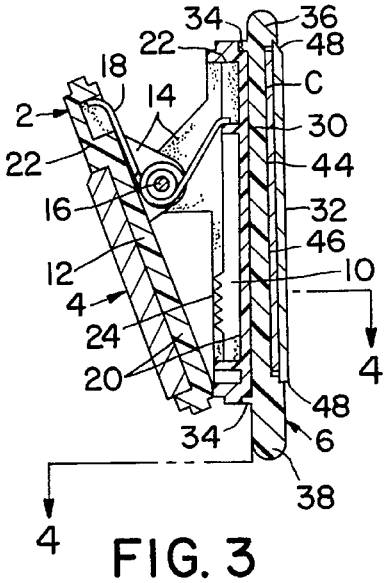
FIG. 3 is a sectional view of the holder taken along line 3—3 of FIG. 2.
Figure 4:
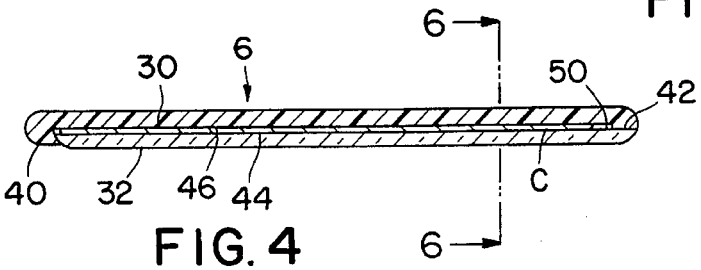
FIG. 4 is a sectional view of the holder taken along line 4—4 of FIG. 3.

The magnet 4 lies embedded within back leg 12 of the clip 2, one of its surfaces being exposed and generally flush with the exterior face of the back leg 12 (FIG. 3). The magnet 4 retains its magnetism, it being formed from ferrous alloy of the type used for permanent magnets. As such the magnet 4 is attracted to the surface S and will hold the clip 2 with a reasonable amount of force against the surface S.

The card carrier 6 is attached firmly to the front leg 10 of the clip 2 and obscures the entire clip 2. It includes (FIGS. 3—6) a backing panel 30 which is slightly larger than the business card C and a lens or cover panel 32 which is transparent and about as large as the card C. Both panels 30 and 32 are molded from suitable polymers. The back face of the backing panel 30 lies along the exterior face of the front leg 10 for the clip 2 and is essentially planar, save for two embossments 34 (FIG. 3) which serve to locate the clip 2 on the backing panel 30. The front leg 10 of clip 2 is attached to the panel 30 between the embossments 34 by welding or by a suitable bonding agent.

At its front face the backing panel 30 has (FIG. 5) a top rib 36, a bottom rib 38 and two end ribs 40 and 42. The four ribs 36, 38, 40 and 42 together create a rim which surrounds a card pocket 44 that is slightly larger than the standard business card which typically measures 3 ½×2 inches. At the back of the pocket 44 a flat back surface 46 extends across the backing panel 30. The front faces of the top rib 36, bottom rib 38 and end rib 40 lie in the same plane, and thus each of those ribs projects the same distance beyond the back surface 46. At their outside margins the ribs 36, 38 and 40 are rounded to provide the carrier 6 with rounded edges along its periphery. The other end rib 42 is somewhat shorter, that is of less depth, and indeed, the top and bottom ribs 36 and 38 project laterally beyond the ends of the end rib 42 where the difference in height is clearly discernible. Even so, the depressed end rib 42 projects beyond the back surface 46 a distance greater than the thickness of the card C. The top rib 36 and end rib 40 are quite narrow, yet about the same width. The bottom rib 38 is considerably wider and as such provides a surface for advertising or other graphical material. Along those surfaces that line the card pocket 44, the top and bottom ribs 36 and 38 have grooves or undercuts 48 which open toward each other. The undercuts 48 extend the full lengths of the ribs 36 and 38, including past the ends of the depressed end rib 42.

Figure 6:
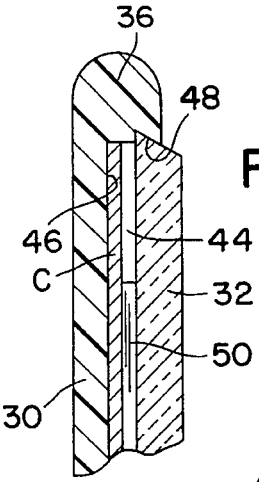
FIG. 6 is an enlarged fragmentary sectional view taken along line 6—6 of FIG. 4.
Figure 5:
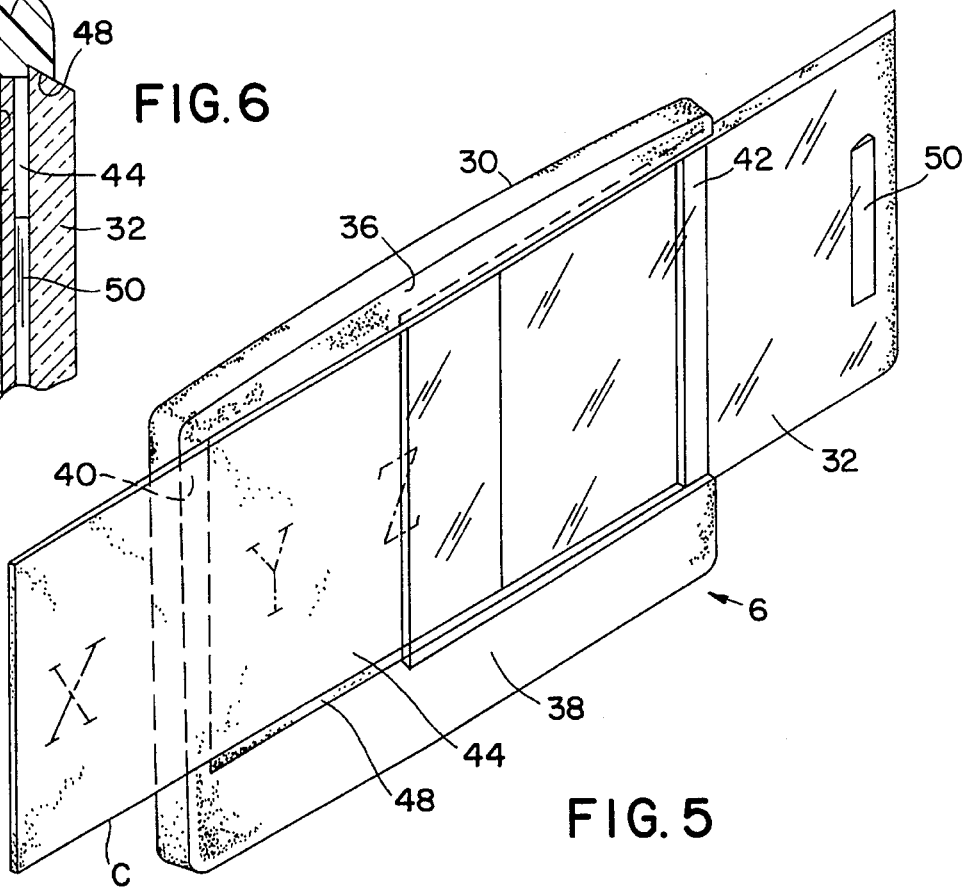
FIG. 5 is a perspective view of the holder showing the cover panel of its carrier withdrawn and a business card being inserted into the carrier.

The lens or cover panel 32 lies over the card pocket 44, yet does not obscure the card pocket 44, inasmuch as it is made from a transparent polymer (FIG. 5). Actually, the cover panel 32 fits between the top rib 36 and the bottom rib 38 and engages the ribs 36 and 38 at their undercuts 48 (FIG. 6). To this end the upper and lower edges of the panels 32 are beveled, creating acute angles along the upper and lower margins of the back face for the panel 32. The edges at these acute angles fit into the undercuts 48 in the top and bottom ribs 36 and 38. The engagement is such that the cover panel 32 will slide toward and away from the end rib 40 unless otherwise restrained, but cannot be lifted away from the back panel 30. The panel 32 is long enough to completely cover the card pocket 44 and the depressed end rib 42 as well, and its end which overlies the depressed rib 42 is beveled to match the bevels on the outside edges of the remaining ribs 36, 38 and 40.

Initially, the cover panel 32 is slightly withdrawn from its fully closed position (FIG. 5) so that the card pocket 44 is exposed between the elevated end rib 40 and end of the cover panel 32. This enables one to slip the business card C into the space between the opening and beneath the portion of the panel 32 still lying over the card pocket 44. The card C is advanced until it lies fully within the pocket 44. At this time the user moves the cover panel 32 toward the elevated end rib 40 until it fully overlies the pocket 44 and the card C within the pocket 44. When so disposed, the end edge of the cover panel 32 lies flush with the end of the backing panel 30, that is the end which lies along depressed end rib 42. On its back face, the cover panel 32 has a locking rib 50 (FIGS. 5 and 6) which lies within the pocket 44 immediately behind the depressed end rib 42 when the cover panel 32 is fully closed (FIG. 1). The rib 42 along its side that is presented toward the depressed end rib is quite abrupt and this prevents the cover panel 32 from being easily withdrawn once it is fully closed. Its opposite side is gently beveled, and this enables the rib 50 to pass easily over the depressed end rib 42 as the cover panel 32 is moved to its fully closed position. In other words, when the locking rib 50 encounters the depressed end rib 42 as the cover panel 32 is closed, the beveled side of the locking rib 50 serves as a cam to deflect the panel 32 into a bowed configuration and away from the depressed rib 42 until the locking rib 50 is beyond the depressed end rib 42, whereupon the cover panel 32 snaps back to its original configuration, with the locking rib 50 lodged behind the depressed end rib 42.

In use, one installs the holder A on the ferrous metal surface S simply by placing the back leg 12 of the clip 2 against the surface S (FIG. 1). The magnet 4, which is embedded in the back leg 12, attaches the clip 2 to the surface S and retains the holder A on the surface S. The clip 2 presents the carrier 6 slightly outwardly from the surface S and the carrier 6 displays the business card C quite prominently along with any graphics on the bottom rib 38. As such the individual who distributes the holder with that individual's business card C in it has the business card C prominently displayed in the recipients home or office.

Apart from serving as a prominent display for the business cards, the holder A serves to support paper or other light objects on the vertical surface S. To this end, the user merely presses the carrier 6 toward the surface near the center of the top rib 36. This opens the clip 2, spreading the clamping portions 20 of its legs 10 and 12 against the bias of the spring 18. The user then inserts the object, which may be a paper or perhaps an item made from cloth, such as a towel, between the clamping portion 20 of the legs 10 and 12 and releases the carrier 6. The clip 2 closes and the clamping portions 20 of its legs 10 and 12 firmly grip the object.

As an alternative construction the cover panel 32 may be permanently attached to the backing panel 30 by ultrasonic welding or other techniques for bonding polymers. But no bond should exist along the depressed rib 42, thus leaving a slot large enough to accommodate the business card C. When the cover panel 32 is permanently bonded, the locking rib 50 is no longer necessary and it is eliminated. Once the card C is inserted fully into the slot between the depressed rib 42 on the backing panel 30 and the end of the cover panel 32, it drops into the pocket 44. The depressed rib 42 prevents the card C from falling out of the pocket 44.

This invention is intended to cover all changes and modifications of the example of the invention herein chosen for purposes of the disclosure which do not constitute departures from the spirit and scope of the invention.

What is claimed is:

1. A holder for supporting a light object, such as a sheet of paper, along a surface that is capable of attracting a magnet, said holder comprising: a carrier having a pocket that opens forwardly and is configured to receive a business card; a clip mounted on the back of the carrier such that pocket opens away from the clip, the clip having clamping portions and a spring which urges the clamping portions together to grip an object that is between the clamping portions, the clip being substantially smaller than the carrier and positioned such that it is substantially obscured by the carrier; and a magnet attached to the clip and presented rearwardly such that it may be placed against a surface that is capable of attracting a magnet so as to attract the clip to and hold it against that surface, whereby the carrier and a business card in it are presented in front of the surface.

2. A holder according to claim 1 wherein the carrier includes a backing panel in which the pocket is located and a transparent cover panel which fits over the pocket; and wherein the clip is attached to the carrier at the backing panel of the carrier.

3. A holder according to claim 2 wherein the cover panel moves relative to the backing panel to expose the pocket so that a business card may be inserted into the pocket.

4. A holder according to claim 3 wherein the cover panel slides on the backing panel to expose the pocket.

5. A holder according to claim 2 wherein the clip has legs which move away from each other to receive the object and toward each other to grip the object, the clamping portions being on the legs.

6. A holder according to claim 5 wherein the clip is attached to the backing member of the carrier along one of the legs of the clip.

7. A holder according to claim 6 wherein the magnet is on the other leg of the clip.

8. A holder according to claim 6 wherein the magnet is embedded in the other leg of the clip.

9. A holder according to claim 6 wherein the legs of the clip pivot relative to each other.

10. A holder for supporting light objects, such as paper, along a ferrous metal surface, said holder comprising: a clip having legs which are biased toward each other to grip the object, but may be spread apart against the bias to receive the object to be supported; a magnet on one of the legs for holding the clip against the metal surface by magnetic attraction; a carrier attached to the other leg of the clip and including a backing panel having a pocket that opens away from the clip and is configured to receive a business card, the backing panel being larger than the clip and substantially obscuring the clip when the clip is against a metal surface, the carrier further including a transparent cover panel that is attached to the backing panel and extends over the pocket to retain a business card in the pocket.

11. A holder according to claim 10 wherein the backing panel has a rim which surrounds the pocket and is formed from ribs, and one of the ribs is wider than the other rib, so that it may display graphical material.

12. A holder according to claim 10 wherein the cover panel for the carrier slides on the backing panel for the carrier between a closed position in which it completely covers the pocket of the carrier and an open position wherein the pocket is exposed.

13. A holder for supporting a light object, such as a sheet of paper, along a surface that is capable of attracting a magnet, said holder comprising: a carrier including a backing member and a transparent cover, the backing member having a pocket that opens forwardly and is configured to receive a business card, the cover overlying the pocket on the backing member to protect a business card in the pocket, the cover being releasably engaged with the backing member such that it can be displaced relative to the pocket to enable a business card to be inserted into the pocket; a clip mounted on the back of the backing member of the carrier such that pocket opens away from the clip, the clip having clamping portions and a spring which urges the clamping portions together to grip an object that is between the clamping portions; and a magnet attached to the clip and presented rearwardly such that it may be presented against a surface that is capable of attracting a magnet so as to attract the clip to and hold it against that surface, whereby the carrier and a business card in it are presented in front of the surface.

14. A holder for supporting a light object, such as a sheet of paper, along a surface that is capable of attracting a magnet, said holder comprising: a carrier including a backing member having a pocket that opens forwardly and is configured to receive a business card, the carrier also including a transparent cover which is mounted on the backing member and overlies the pocket to protect a business card in the pocket, the carrier also including means for providing access to the pocket to insert a business card in the pocket; a clip mounted on the back of the backing member such that pocket opens away from the clip, the clip having clamping portions and a spring which urges the clamping portions together to grip an object that is between the clamping portions, the clip being substantially smaller than the carrier; and a magnet attached to the clip and presented rearwardly such that it may be placed against a surface that is capable of attracting a magnet so as to attract the clip to and hold it against that surface, whereby the carrier and a business card in it are presented in front of the surface.

* * * * *